US008138921B1

(12) United States Patent
Cleeves et al.

(10) Patent No.: US 8,138,921 B1
(45) Date of Patent: Mar. 20, 2012

(54) RELIABLE TAG DEACTIVATION

(75) Inventors: James Montague Cleeves, Redwood City, CA (US); Vivek Subramanian, Orinda, CA (US)

(73) Assignee: Kovio, Inc., San Jose, CA (US)

( * ) Notice: Subject to any disclaimer, the term of this patent is extended or adjusted under 35 U.S.C. 154(b) by 241 days.

(21) Appl. No.: 12/189,037

(22) Filed: Aug. 8, 2008

Related U.S. Application Data

(60) Provisional application No. 60/964,287, filed on Aug. 9, 2007.

(51) Int. Cl.
*G08B 13/14* (2006.01)

(52) U.S. Cl. ..... 340/572.3; 235/385

(58) Field of Classification Search ..... 340/572.3, 340/572.1, 572.4, 10.2; 235/383, 385
See application file for complete search history.

(56) References Cited

U.S. PATENT DOCUMENTS 3,967,161 A * 6/1976 Lichtblau ..... 340/572.5
4,498,076 A * 2/1985 Lichtblau ..... 340/572.3
4,728,938 A 3/1988 Kaltner
5,059,951 A 10/1991 Kaltner
5,257,010 A * 10/1993 Rehder ..... 340/572.3
5,640,151 A * 6/1997 Reis et al. ..... 340/10.2
6,359,562 B2 3/2002 Rubin
6,857,567 B2 * 2/2005 Latimer et al. ..... 235/383
7,132,947 B2 * 11/2006 Clifford et al. ..... 340/572.3
7,495,564 B2 * 2/2009 Harold et al. ..... 340/572.3
7,527,198 B2 * 5/2009 Salim et al. ..... 235/385
7,642,915 B2 * 1/2010 Eckstein ..... 340/572.5
2007/0210922 A1 * 9/2007 Clifford et al. ..... 340/572.3

* cited by examiner

*Primary Examiner* — John A Tweel, Jr.
(74) *Attorney, Agent, or Firm* — The Law Offices of Andrew D. Fortney; Andrew D. Fortney

(57) ABSTRACT

A method for reliable deactivation of a security (EAS) tag, and an apparatus for accomplishing the same. The method generally includes placing a security tag a first distance from a deactivation apparatus; determining whether a deactivation confirmation signal has occurred; and when it is determined that the deactivation confirmation signal did not occur, placing the security tag closer to the deactivation apparatus. The deactivation apparatus generally includes a pad configured to transmit a deactivation pulse having a power sufficient to deactivate the security tag when it is within a deactivation field; a tag reader configured to detect a signal transmission from an active tag when it is in a read field of the deactivation apparatus; a confirmation indicator configured to indicate that the pad has sent the deactivation pulse; and logic configured to determine when an active tag is in the deactivation field or the read field, and communicate to the confirmation indicator that the pad has sent the deactivation pulse.

34 Claims, 7 Drawing Sheets

RELIABLE TAG DEACTIVATION

RELATED APPLICATIONS

This application claims the benefit of U.S. Provisional Application No. 60/964,287, filed Aug. 9, 2007, which is incorporated herein by reference in its entirety.

FIELD OF THE INVENTION

The present invention generally relates to the field of electronic security and dual use tags (e.g., EAS, RFID, etc.) and devices. More specifically, embodiments of the present invention pertain to methods for deactivating a security/dual use tag and apparatuses for the same.

SUMMARY OF THE INVENTION

Aspects of the present invention relate to a method of deactivating security/dual use tags, a security/dual use tag deactivation apparatus, and variations thereof. The methods and apparatuses described in the present invention enable the reliable deactivation of the tags (e.g., electronic article surveillance (EAS)) so that the tags are completely deactivated and do not reactivate (e.g., the Lazarus effect). In one embodiment, this invention modifies conventional (EAS) tag readers, and more specifically, deactivation pads associated with such readers, to include read electronics (e.g., circuitry configured to read a tag within a certain range of the pad). Such a modification can be utilized in various ways, some of which are explicitly described below with regard to the method of the present invention.

According to the general method of the present invention, a security/dual use tag may be deactivated by placing the tag a first distance from a deactivation apparatus and determining whether a deactivation confirmation signal has occurred. The deactivation confirmation signal will occur if the tag is within a sufficient deactivation distance of the deactivation apparatus. If the deactivation confirmation signal did not occur, the tag is then moved closer to the deactivation apparatus to ensure that the tag is deactivated. In exemplary embodiments, the first distance is within a specified deactivation field of the deactivation apparatus.

In other embodiments, it may be beneficial to read the tag before determining whether the deactivation confirmation signal has occurred. In addition, it may also be beneficial to determine the distance from the pad to the tag (i.e., the "pad-to-tag" distance) based on a coupling coefficient measured with the tag. In embodiments that determine the pad-to-tag distance, the confirmation signal may be generated when the pad-to-tag distance is sufficiently close to deactivate the tag. Additionally or alternatively, a warning signal may be generated when the pad-to-tag distance is not sufficiently close to deactivate the tag.

In another aspect, the present invention concerns a security tag deactivation apparatus. In general the deactivation apparatus comprises a pad configured to transmit a deactivation pulse having a power sufficient to deactivate the security tag when the security tag is within a deactivation field of the deactivation apparatus. The deactivation pulse transmitted may be a radio frequency, high frequency, very high frequency, or ultra high frequency pulse or signal. The apparatus also includes a tag reader configured to detect a signal transmission from an active tag when the active tag is within a read field of the deactivation apparatus, a confirmation indicator configured to indicate that the pad has sent the deactivation pulse, and logic configured to determine when the security tag is within the deactivation field, determine when the tag is active in the read field, and communicate to the confirmation indicator that the pad has sent the deactivation pulse. Preferably, the read field has a greater volume than the deactivation field.

In various embodiments of the deactivation apparatus, the reader may be configured to attempt to detect a signal transmission before the confirmation indicator indicates that the deactivation pad has sent a deactivation pulse. In other embodiments, the reader may be configured to determine the distance from the pad to the tag (i.e., the "pad-to-tag" distance). In such embodiments, the confirmation indicator may be configured to generate a confirmation signal when the pad-to-tag distance is sufficiently close to deactivate the tag. In other variations, the deactivation pulse has sufficient power to form a short circuit between two conductive plates or members across a dielectric in the security tag. In such embodiments, the dielectric may be an organic dielectric or an inorganic dielectric. Furthermore, the dielectric may have a breakdown voltage and the deactivation pulse may have a power sufficient to generate an electric potential greater than the breakdown voltage, across the dielectric when the security tag is with the deactivation field.

The present invention provides a security/dual use tag deactivation apparatus and methods for reliably deactivating a security/dual use tag by modifying a deactivation pad to include circuitry configured to read the tags within a certain range of a deactivation pad. Using read circuitry that is able to estimate a coupling coefficient between the security tag and the deactivation pad, an attempt to deactivate a tag before the tag is close enough to the pad to achieve reliable deactivation may be avoided, and it is possible to subsequently verify that the pad has completely and actually deactivated the tag before it is taken away from the deactivation apparatus.

These and other advantages of the present invention will become readily apparent from the detailed description of preferred embodiments below.

DETAILED DESCRIPTION OF THE PREFERRED EMBODIMENTS

Figure 1:
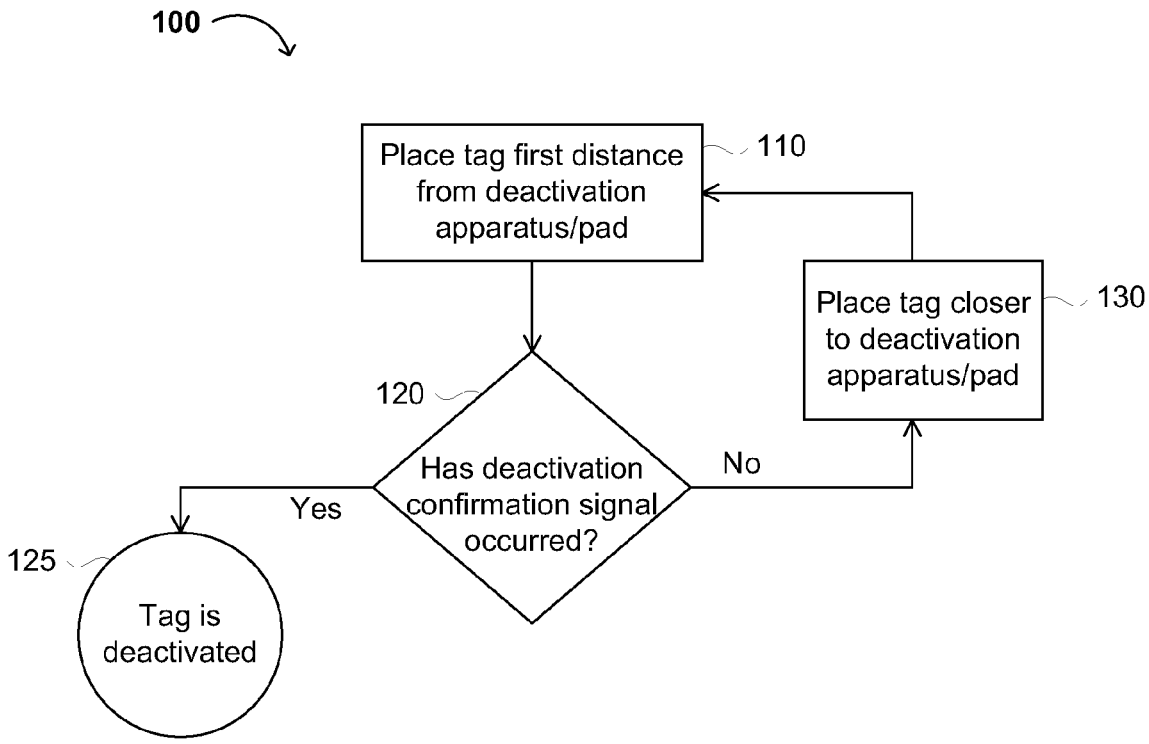
FIG. 1 shows a first general process flow for an exemplary method, in accordance with the present invention.

Reference will now be made in detail to preferred embodiments of the invention. While the invention will be described in conjunction with the following preferred embodiments, it will be understood that the description is not intended to limit the invention to these embodiments. On the contrary, the invention is intended to cover alternatives, modifications and equivalents that may be included within the spirit and scope of the invention as defined by the appended claims. Furthermore, in the following detailed description of the present invention, numerous specific details are set forth in order to provide a thorough understanding of the present invention. However, it will be readily apparent to one skilled in the art that the present invention may be practiced without these specific details. In other instances, well-known methods, procedures, components, and circuits have not been described in detail so as not to unnecessarily obscure aspects of the present invention.

For the sake of convenience and simplicity, the terms "coupled to," "connected to," and "in communication with" mean direct or indirect coupling, connection or communication unless the context indicates otherwise. These terms are generally used interchangeably herein, but are generally given their art-recognized meanings. Also, for convenience and simplicity, the terms "surveillance," "EAS," and "security" may be used interchangeably with respect to intended uses and/or functions of a device and/or tag, and the terms "EAS," "dual use," "surveillance," and "security" when referring to a tag or device may be used herein to refer to any tag and/or device having an EAS function. Furthermore, there are many possible variations of the process flows and apparatuses described herein. Accordingly, it should be understood that the possible permutations and combinations described herein are not meant to limit the invention. Specifically, variations that are not inconsistent may be mixed and matched as desired.

Aspects of the present invention concern methods for deactivating security tags, and security tag deactivation apparatuses for accomplishing the same. The general method for deactivating security tags comprises (a) placing the security tag a first distance from a deactivation apparatus; (b) determining whether a deactivation confirmation signal has occurred; and (c) when the deactivation confirmation signal has been determined not to have occurred, placing the security tag closer to the deactivation apparatus than the first distance.

In some variations of the general method, the tag is read before determining if the deactivation confirmation signal occurred. In other variations, the method further comprises reading the security tag to determine the pad-to-tag distance based on a coupling coefficient measured with the tag. The pad-to-tag distance can be used to subsequently cause a deactivation pad in the deactivation apparatus to take action or not to take action. For example, if the pad-to-tag distance is determined to be insufficiently close to deactivate the tag, then the deactivation pad will not transmit a deactivation pulse to deactivate the tag. On the other hand, if the pad-to-tag distance is sufficiently close to deactivate the tag, the deactivation pad will transmit a deactivation pulse.

A further aspect of the present invention concerns a security tag deactivation apparatus, comprising (a) a pad configured to transmit a deactivation pulse having a power sufficient to deactivate a security tag when the security tag is within a deactivation field of the deactivation apparatus; (b) a tag reader configured to detect a signal transmission from an active tag when the active tag is within a read field of the deactivation apparatus, the read field having a greater volume than the deactivation field; (c) a confirmation indicator configured to indicate that the pad has sent the deactivation pulse; and (d) logic configured to determine when the security tag is within the deactivation field, determine when an active tag is in the read field, and communicate to the confirmation indicator that the pad has sent the deactivation pulse.

In some embodiments, the reader may be configured to attempt to detect a signal from the tag before the confirmation indicator indicates that the pad has sent the deactivation pulse. Alternatively or additionally, the reader may be configured to determine the distance from the pad to the tag (i.e., the "pad-to-tag" distance). In such embodiments, the tag may be deactivated (or not deactivated) by the deactivation pad depending on the pad-to-tag distance as determined by the read circuitry in the deactivation apparatus.

The invention, in its various aspects, will be explained in greater detail below with regard to exemplary embodiments.

Exemplary Methods of Deactivating a Security Tag

A first aspect of the present invention relates to methods of deactivating a security tag (e.g., an EAS tag or dual use EAS/RFID tag, etc.). Dual use (e.g., multi-mode) tags and methods of making and using such tags are described in U.S. Pat. No. 7,286,053, issued Oct. 23, 2007 and U.S. patent application Ser. No. 11/870,775, filed Oct. 11, 2007, the relevant portions of which are incorporated herein by reference. As illustrated in the process flow shown in FIG. 1, the general method 100 comprises placing the security tag a first (e.g., predetermined) distance from a deactivation apparatus (see step 110), and subsequently determining whether a deactivation confirmation signal has occurred (see question box 120). The deactivation apparatus may determine if the deactivation confirmation signal has occurred by automatically detecting the presence of the tag. Alternatively, the user may first trigger the apparatus by taking an action, such as activating a switch or pressing a button, to prompt the apparatus to determine or indicate whether the deactivation confirmation signal has occurred.

Specifically, the deactivation confirmation signal occurs when the tag is sufficiently close to (e.g., within a deactivation distance of) a deactivation pad within the deactivation apparatus, and a deactivation pulse has been sent/transmitted. For example, if read circuitry in the apparatus determines that the tag is within the deactivation distance (e.g., the deactivation field of the deactivation pad), the pad then transmits a deactivation pulse. The pulse generally has power sufficient to deactivate the security tag when the tag is within the deactivation field of the deactivation apparatus. When a tag is successfully deactivated, as indicated in step 125 (e.g., the tag is within the deactivation field and a pulse is transmitted), the deactivation confirmation signal occurs. However, if the deactivation confirmation signal does not occur, then the apparatus has determined that the tag does not meet the conditions for successful deactivation, and the security tag should be placed closer to the deactivation apparatus (see step 130). Optionally, a confirmation indication and/or warning signal may be sent to a user to indicate that the tag has or has not been deactivated, as described herein with regard to FIGS. 2-6.

Typically, the first distance should be (or is) within a specified or predetermined deactivation field of the deactivation apparatus. Although there is no specific standard for the parameters that define the deactivation field, the deactivation field or distance is generally defined by the breakdown voltage of the capacitor dielectric on the tag, or the pulse density of the deactivation pulse transmitted by the pad. In the alternative, if tag deactivation is accomplished by another method (e.g., programming an EEPROM bit, etc.), then the deactivation distance depends on parameters relating to the method chosen to deactivate the tag.

In some implementations, a reader may read the security tag(s) before determining whether the deactivation confirmation signal has occurred. In these implementations, the first distance should be sufficient to read and/or detect the tag. Although there is no specific standard with regard to the parameters defining the read and/or detection field, in general, the read distance is determined by the output power of the reader and the minimum amount of power for the tag to operate (e.g., absorb and backscatter the signal transmitted by the reader). The minimum amount of power is dependent upon factors that may include the size and geometry of the reader antenna (e.g., a larger antenna diameter provides a longer read range), the size and geometry of the tag antenna, the tag antenna quality factor, the tag-to-reader orientation, and the presence of absorbers (e.g., metals) in the vicinity of the tag and reader.

Figure 2:
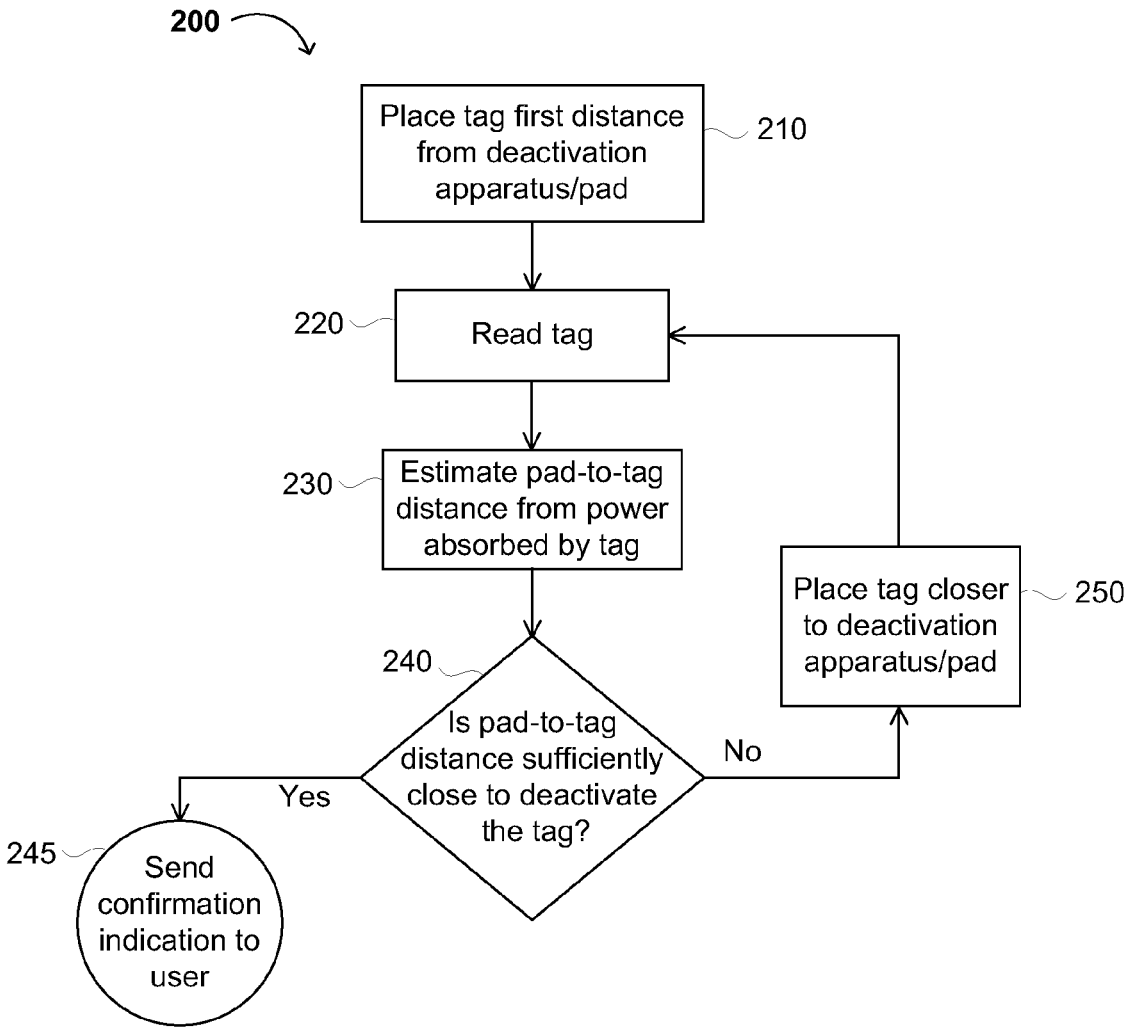
FIG. 2 shows a second exemplary process flow, in accordance with the present method.

An exemplary process flow 200 illustrating this variation is provided in FIG. 2. A tag is placed a first distance from the deactivation apparatus/pad (see step 210). As shown in step 220, the tag is read. In such implementations, it may be advantageous to determine (e.g., estimate) the distance from the pad to the tag (see step 230). In some embodiments, the pad-to-tag distance may be determined from a read signal coupling between the pad and the tag. Implementations that include determining the pad-to-tag distance may further comprise ascertaining whether the pad-to-tag distance is sufficiently close to ensure delivery of a deactivation pulse of sufficiently high power to deactivate the tag, as shown in question box 240. This may be accomplished by determining a coupling coefficient between the tag and the deactivation apparatus. The coupling coefficient is generally a measure of the fractional power radiated by the reader that is absorbed by the tag. In other words, it is a ratio of power absorbed by the tag to the power radiated by the reader. In practice, coupling coefficients are generally in the range of 1-20% (e.g., 2-5%, or some other range of values greater than 1%, but less than about 20%). While the reader generally does not measure the specific value of the coupling coefficient, it is capable of estimating the loading imposed by the tag (e.g., the power absorbed by the tag) by measuring the power drawn from the reader antenna. If the logic determines that that the pad-to-tag distance is close enough to deactivate the tag, the tag is deactivated and a confirmation indication may be sent to the user (see step 245). However, if the logic determines that the pad-to-tag distance is insufficient, the user should place the tag closer to the deactivation apparatus (see step 250).

Figure 3:
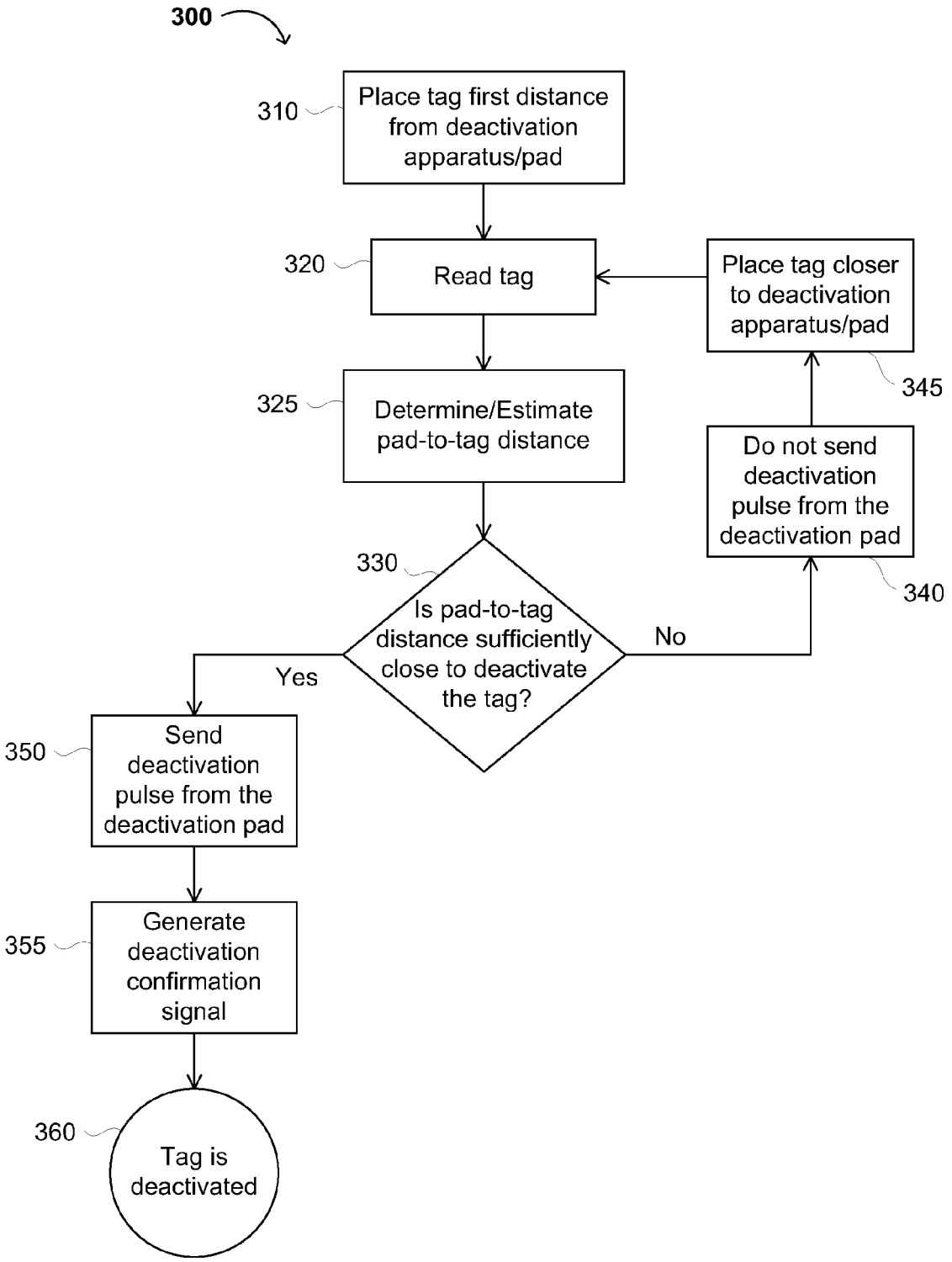
FIG. 3 illustrates a third exemplary process flow, in which a deactivation pulse from the deactivation pad is sent to the tag if the pad-to-tag distance is sufficiently close for tag deactivation.

In some embodiments, the deactivation pulse may be transmitted from the deactivation apparatus when the pad-to-tag distance is sufficiently close to deactivate the tag. Alternatively or additionally, the deactivation apparatus/pad will not transmit the deactivation pulse if it is determined that the pad-to-tag distance is not sufficiently close to deactivate the tag. FIG. 3 shows an exemplary process flow 300 according to this variation. Specifically, in FIG. 3, a tag is placed a first distance from a deactivation apparatus and pad, as shown in step 310. The tag is read (step 320) to determine if the pad-to-tag distance is sufficient to deactivate the tag (e.g., the tag has a sufficiently high coupling coefficient to deactivate properly), as shown in step 325. If the pad-to-tag distance is sufficient to deactivate the tag (see question box 330), a deactivation pulse is sent to the tag from the deactivation pad (see step 350), a deactivation confirmation signal is generated (see step 355), and the tag is deactivated (see step 360). If the distance is insufficient to deactivate the tag, the deactivation pulse is not sent (see step 340), and the tag is placed closer to the deactivation apparatus and pad (see step 345) in order for it to be deactivated.

Figure 4:
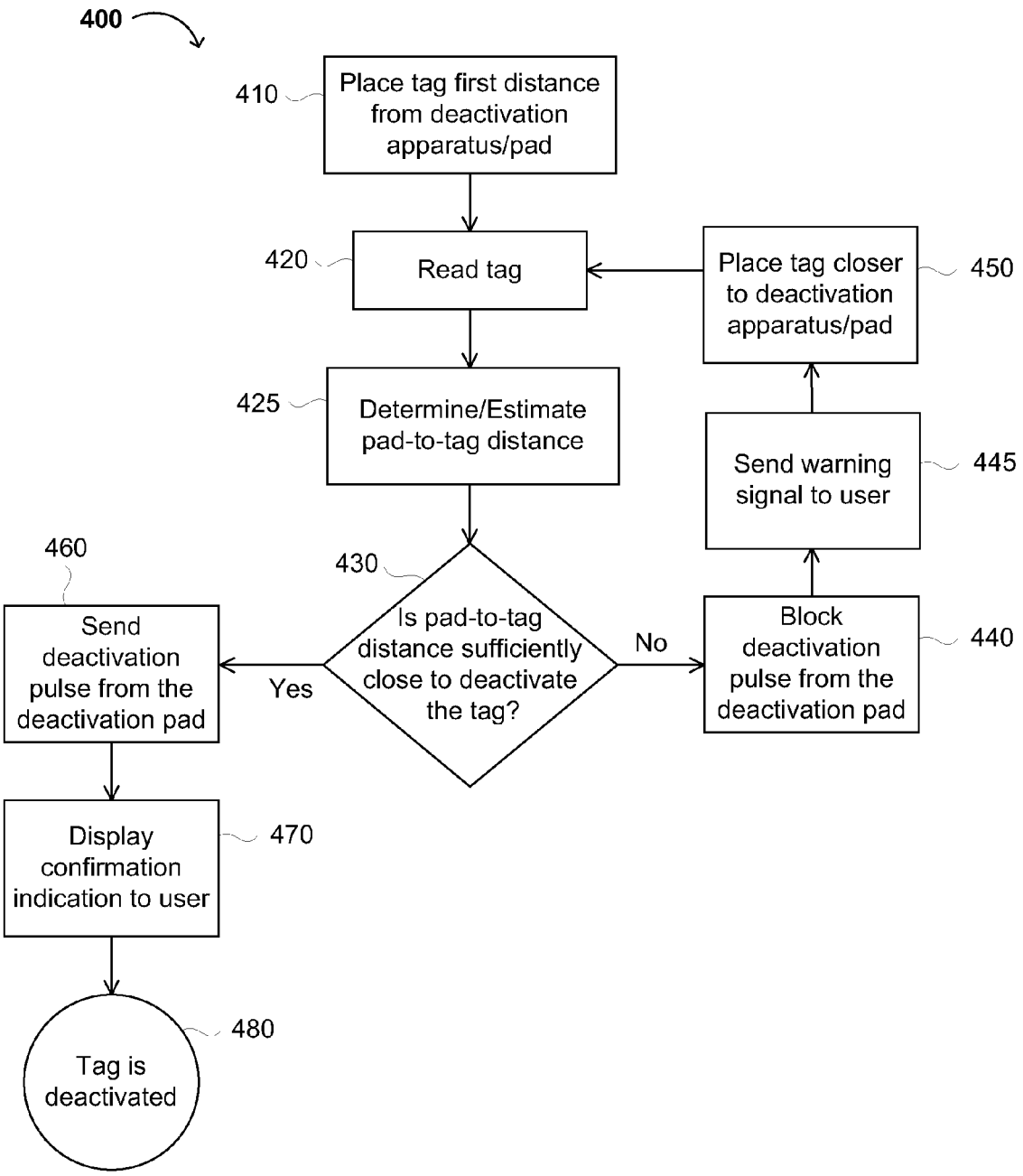
FIG. 4 illustrates a variation of the exemplary process flow of FIG. 3, in which a confirmation indication and/or a warning signal is sent to the user to indicate that a tag has or has not been deactivated.

Further variations of this embodiment include sending confirmation indications and/or warning signals to a user, indicating that the tag has or has not been deactivated. The process flow 400 of FIG. 4 illustrates this implementation. As shown in FIG. 4, a tag is placed a first distance from the deactivation apparatus/pad (see step 410), the tag is read (see step 420), the pad-to-tag distance is determined/estimated (see step 425), and the logic determines whether the pad-to-tag distance is sufficient to deactivate the tag (see step 430). If the pad-to-tag distance is sufficient, the deactivation pulse is transmitted from the deactivation pad, as show in step 460. After the deactivation pulse is transmitted, a confirmation indication is displayed to the user (see step 470) indicating that the tag is deactivated. If the logic determines that the pad-to-tag distance is insufficient (see question block 430), the deactivation pulse is blocked (see step 440), and a warning signal may be sent to the user (see step 445) to alert the user that the tag has not been deactivated, and the tag is moved closer to the deactivation apparatus (see step 450).

Figure 5:
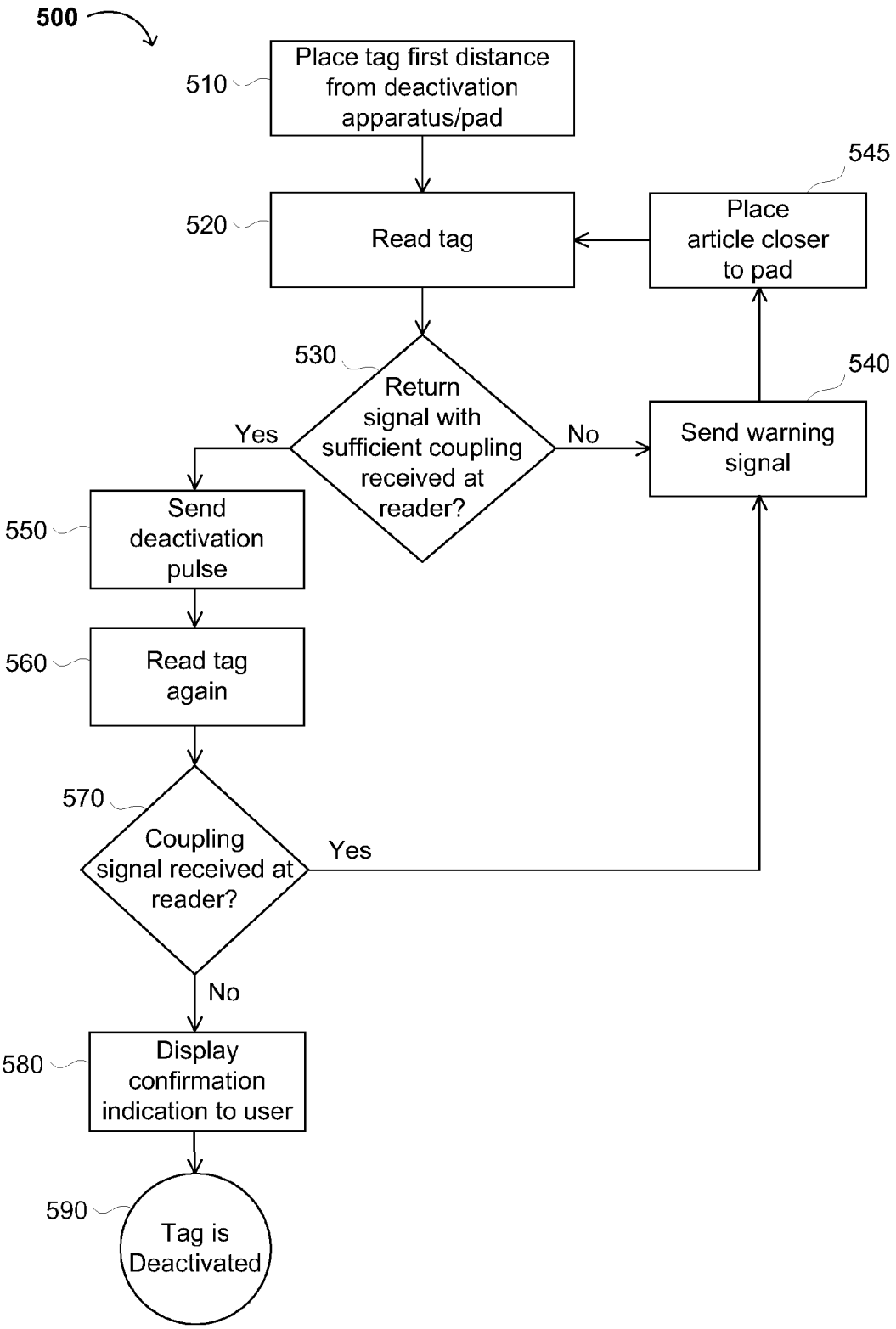
FIG. 5 shows a fourth exemplary process flow for the present method, in which the tag is read a second time after sending the deactivation pulse to determine if the tag is still active.

In further embodiments, the reader may read a tag (and/or tag population) within a read field after transmitting the deactivation pulse, to determine if there are any (remaining) active tags within the deactivation field. Preferably, in such embodiments, the read field volume is from 2 to 10 (e.g., 2 to 4) times that of the deactivation field. In many instances, the read field volume may be defined by a distance from the pad in which the tag can be detected. An exemplary process flow 500 according to this embodiment is shown in FIG. 5. In such embodiments, the tag is read twice during the process, once before transmitting the deactivation pulse to determine if the pad-to-tag distance is sufficiently close to deactivate the tag (see step 520), and again after sending the deactivation pulse (see steps 550 and 560) to determine if an active tag is present in the deactivation field. In such embodiments, the predetermined read field may have a volume of at least 1.5 times that of the deactivation field volume. If active tags are identified after the second read operation (step 560), a warning signal (see step 540) can alert a user that at least one tag within the deactivation field has not been successfully deactivated. If no active tags are identified after the second read operation (step 560), a confirmation indication may be displayed to the user (see step 580) indicating that all tags were successfully deactivated.

Additionally, in many of the above-described variations, a warning signal may also be generated if the pad-to-tag distance is not sufficiently close to deactivate the tag. Similarly, it is also possible to generate a confirmation indication when the pad-to-tag distance is sufficiently close to deactivate the tag prior to deactivating the tag. Such warning signals and/or confirmation indications may include visual and/or audible confirmation (e.g., a red light and/or a buzzer as a warning indicator; a green light and/or a bell as a confirmation indicator). However, the warning signals and/or confirmation indications are not limited to only visual and/or audible indicators. For example, the warning signals/confirmation indications may be displayed on a computer for the user, and/or include any other type of sensory feedback, such as tactile indicators (e.g., a silent vibrating device) or olfactory indicators (e.g., release of a pleasant scent). In exemplary embodiments, the confirmation indication and/or warning signal is generated within a predetermined period of time. The time between deactivation confirmation and generation of the confirmation indication (or warning signal if deactivation failed) is relatively short. Response times are preferably less than a second (e.g., milliseconds) and response times in the range of tens of seconds are too long.

Figure 6:
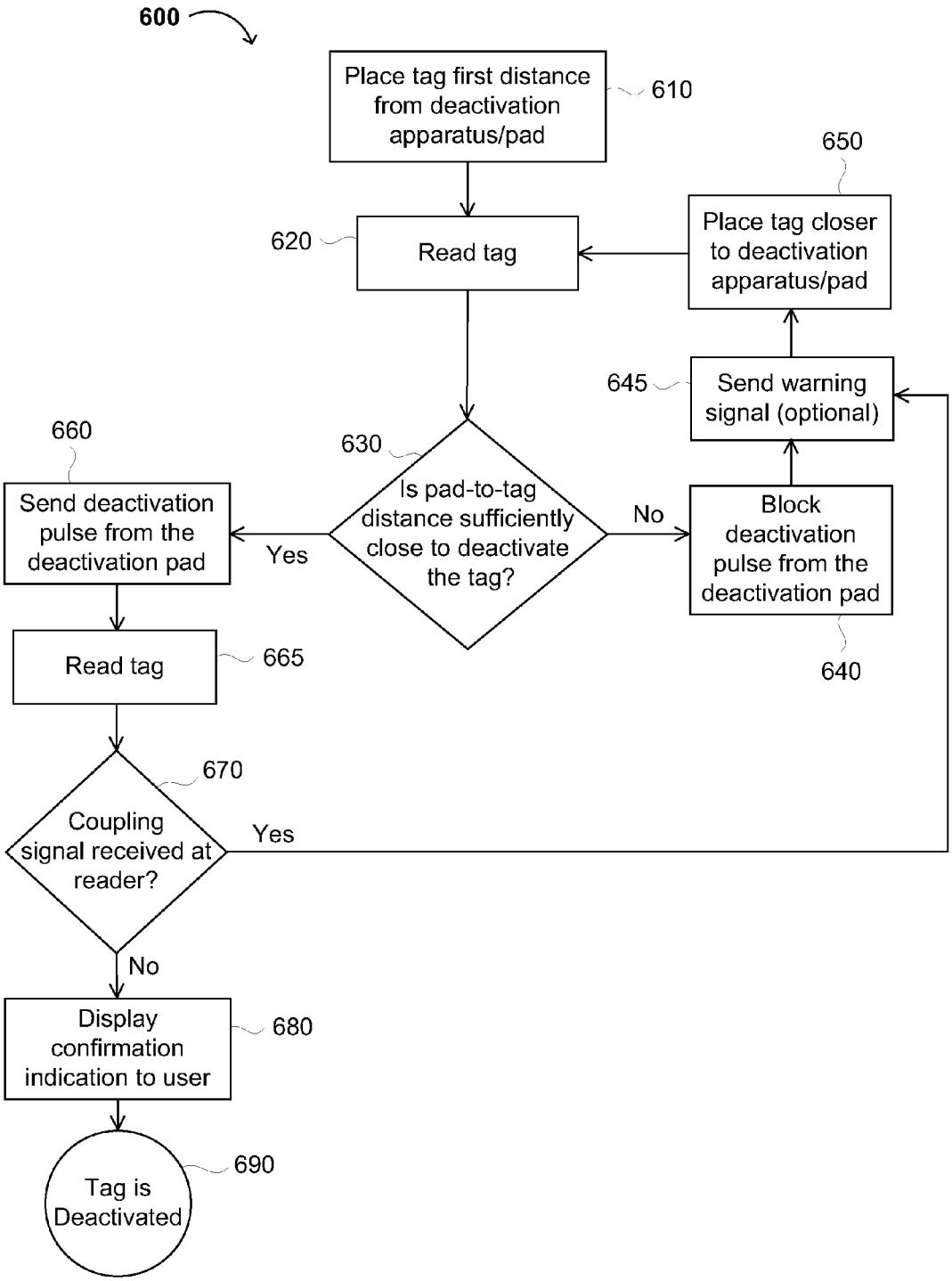
FIG. 6 illustrates a variation of FIG. 5, in which a confirmation indication and/or a warning signal is sent to the user.

An exemplary process flow 600 according to a further embodiment of the present method is shown in FIG. 6. In this embodiment, an article having a security tag therein or thereon is placed near the deactivation apparatus (including the deactivation pad), as shown in step 610. The tag is read (see step 620) to determine if the pad-to-tag distance is sufficiently close to deactivate the tag (see question box 630). If it is close enough, and the coupling coefficient exceeds a predetermined threshold value (e.g., 1%), a deactivation pulse is transmitted from the deactivation pad (see step 660) to deactivate the tag. If the coupling coefficient does not exceed the predetermined threshold value, the deactivation pad blocks the deactivation pulse (see step 640), and the tag is not deactivated. A warning signal may be sent to the user (see step 645). The user then places the tag closer to the deactivation apparatus (see step 650), and the tag is read again (see step 620). This cycle (steps 620, 630, 640, 645, and 650) is repeated until the tag is successfully deactivated.

On the other hand, if the deactivation apparatus sends the deactivation pulse to the tag (see step 660), a reader subsequently reads the tag (see step 665) to determine if there are any active tags remaining within the read field (see question box 670). In general, the read field should be 2 to 4 times the volume of the deactivation field, so that tags within a distance from the pad and/or reader that can be detected, but were not deactivated, can be recognized. This can be accomplished by determining whether a coupling signal was transmitted by the tag and received by the reader (question box 670). Once such tags are recognized, a warning signal may be sent to the user (see step 645) indicating that at least one active tag is within the read field (i.e., close to the deactivation pad), and has not deactivated. The user then places the tag (and an article upon or in which the tag may be affixed) closer to the deactivation pad (see step 650), and the cycle (steps 620, 630, 640, 645, and 650) repeats to ensure that the tag is deactivated. In the alternative, a confirmation indication may optionally be sent to the user (see step 680) if the reader did not receive a coupling signal from the tag(s) in the read field, which indicates that the tag has been deactivated (see step 690).

In some embodiments, the tag may be deactivated by forming a short circuit between two conductive plates or members across a dielectric. In such embodiments, the dielectric may be an organic or an inorganic dielectric. The organic dielectric may comprise polyimide, poly(benzocyclobutene) [BCB], or SiLK® dielectric material (SiLK is a registered trademark of Dow Chemical Co., Midland, Mich.). Possible inorganic materials may comprise aluminum oxide, silicon dioxide [which may be conventionally doped and/or which may comprise a spin-on-glass], silicon nitride, silicon oxynitride, or a combination thereof as a mixture or a multilayer structure, silicates, silicones, sesquioxanes, tetraalkoxysilanes, trialkoxyaluminum compounds, titanium tetraalkoxides, and/or nanoparticles of silica, alumina, ceria, titania, zirconia, etc. The dielectric used in these variations may have a breakdown voltage of, e.g., at least 2 V, 5 V, 10 V, 15 V, 20 V, or any minimum value greater than 2 V, up to a maximum of 25 V, 30 V, 40 V or other value greater than the minimum value. The short circuit between the conductive plates or members may be formed by applying an electric potential greater than the breakdown voltage across the dielectric. In various embodiments, the electric potential may be generated by the tag from a radio frequency, high frequency, very high frequency, or ultra high frequency signal from the deactivation apparatus.

Exemplary Security Tag Deactivation Apparatuses

A second aspect of the present invention concerns a security tag deactivation apparatus. Generally, the apparatus comprises a pad configured to transmit a deactivation pulse having a power sufficient to deactivate the security tag when the tag is within a deactivation field of the deactivation apparatus. The apparatus also comprises a tag reader configured to detect a signal transmission from an active tag when the active tag is within a read field of the deactivation apparatus. The tag reader may also be configured to detect a transmitted signal from a tag and/or comprise logic for generating confirmation and warning indicator signals. Typically, the read field has a greater volume than the deactivation field. The apparatus may further include one or more confirmation indicators configured to indicate that the pad has or has not sent the deactivation pulse. In addition, the apparatus comprises logic to determine when the security tag is within the deactivation field, determine when an active tag is in the read field, and communicate the deactivation confirmation signal. The logic communicates with the other elements of the apparatus, and triangulates their activities accordingly.

The deactivation pulse transmitted by the pad may be a radio frequency, high frequency, very high frequency, or ultra high frequency signal. In some variations, the deactivation pulse has a power sufficient to form a short circuit between two conductive plates or members across a dielectric in the security tag. In such embodiments, the dielectric may comprise an organic dielectric (e.g., polyimide, poly(benzocyclobutene) [BCB], etc.) or an inorganic dielectric (e.g., aluminum oxide, silicon dioxide [which may be conventionally doped and/or which may comprise a spin-on-glass], silicon nitride, silicon oxynitride, silicates, silicones, sesquioxanes, aluminumates, titanates nanoparticles of silica, alumina, ceria, titania, zirconia, or a combination thereof as a mixture or a multilayer structure). In some variations, the dielectric has a breakdown voltage, and the deactivation pulse has a power sufficient to generate an electric potential greater than the breakdown voltage across the dielectric when the security tag is within the deactivation field.

In some embodiments, the tag reader may be configured to attempt to detect a signal from the tag before the confirmation indicator indicates that the pad has sent the deactivation pulse. In such a case, the reader may include circuitry configured to determine or estimate a coupling coefficient and/or distance between the tag and the deactivation apparatus. As previously discussed, the reader generally does not measure the specific value of the coupling coefficient, and instead estimates the loading imposed by the tag (e.g., power absorbed by the tag) by measuring the power drawn from the reader antenna. Generally, the coupling coefficient is in the range of a few percent (e.g., 1-20%).

Alternatively or additionally, the tag reader may be configured to determine the distance from the pad to the tag (i.e., the pad-to-tag distance). The pad-to-tag distance may be determined from a read signal coupling between the pad and the tag. In such embodiments, the confirmation indicator may be configured not to indicate that the deactivation pulse has been sent when the pad-to-tag distance is not sufficiently close to deactivate the tag. In other variations, the pad may be configured to send a deactivation pulse if the logic determines that the pad-to-tag distance is sufficiently close to ensure delivery of sufficiently high pulse power to deactivate the tag. In these variations, the confirmation indicator may indicate that the deactivation pulse has been sent after the pad sends the deactivation signal.

In one embodiment, the confirmation indicator is configured to generate a confirmation indication when the pad-to-tag distance is sufficiently close to deactivate the tag. The confirmation indication may comprise any type of sensory feedback to the user, and which may include, for example, a visual signal such as a light (e.g., red for warning and/or green for confirmation), an audible signal (e.g., a buzzer for warning and/or a bell for confirmation), a tactile signal (e.g., a vibrating device, such as those commonly found in cellular phones and/or pagers for warning or confirmation), and/or an olfactory signal (such as a pleasant, sweet or flower-like scent, released as a confirmation indication). In exemplary embodiments, the confirmation indication is generated within a predetermined period of time, preferably no more than 1 second (e.g., less than 100 milliseconds).

In another implementation, the tag reader may be configured to attempt to detect the signal transmission before the pad sends the deactivation pulse. In this implementation, the confirmation indicator may be configured to generate a confirmation indication when the reader and/or logic determine that there are no active tags in a predetermined read field. Alternatively or additionally, the deactivation apparatus and/or the confirmation indicator may further comprise a warning indicator mechanism configured to indicate when the deactivation apparatus determines that there is an active tag in the read field. As with the confirmation indication, the warning signal may comprise any sensory feedback as described herein, and is generated within milliseconds of determining that deactivation failed.

Optionally, the tag reader may also be configured to determine whether there are active tags in the read field by broadcasting a wireless transmission at an appropriate frequency and strength. The reader may then determine whether a reply is received. In various implementations, the read field has a volume of at least 1.5 times that of the deactivation field volume. In exemplary implementations, the read field volume is from 2 to 10 (e.g., 2 to 4) times that of the deactivation field. In general, the read field volume can be defined by a distance from the pad in which the tag can be detected.

Figure 7:
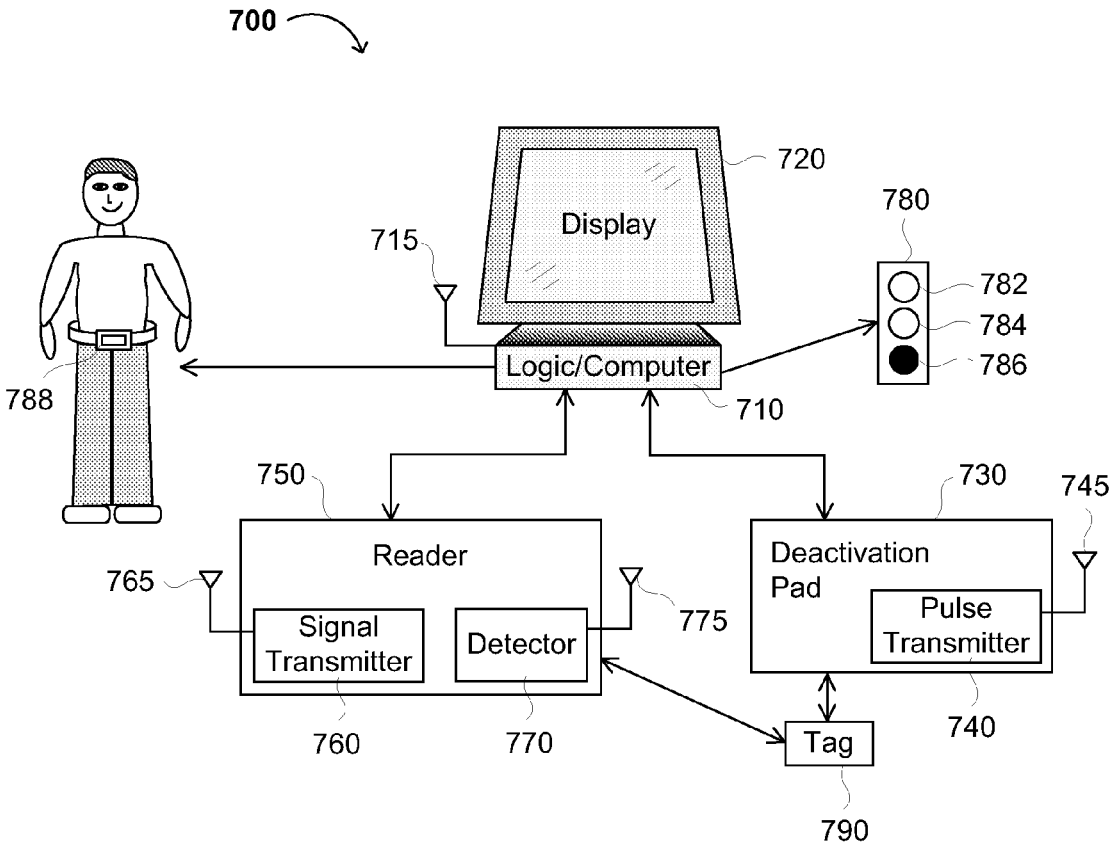
FIG. 7 shows an exemplary security tag deactivation apparatus according to the present invention.

FIG. 7 illustrates an exemplary tag deactivation apparatus 700 according to the present invention. The apparatus of FIG. 7 includes a display/monitor 720, connected to a computer or other logic 710 and an antenna 715. The logic/computer 710 is configured to communicate with a deactivation pad 730, and also with a tag reader 750. The activities of deactivation pad, the reader, and the confirmation indicator are coordinated by the logic of the apparatus. For example, the logic determines when the security tag is sufficiently within the deactivation field, and thus is capable of being successfully deactivated. If the tag is close enough for deactivation, the logic communicates this to the pad, which then sends the deactivation pulse. The logic also determines if an active tag is within the read field and communicates this information to the confirmation indicator, which can then transmit a confirmation indication and/or warning signal to a user regarding the deactivation status of the tag.

Specifically, the logic is configured to receive inputs from the read and deactivation pad, and make determinations and/or decisions based on the inputs received (e.g., whether a tag has been read, and if so how many times (once, twice, etc.); whether power was absorbed when the tag was read, and if so, how much power was absorbed; whether a deactivation pulse was sent, etc.). Furthermore, the logic can be configured to provide confirmation indications and/or warning signals based on the inputs received from the reader and the deactivation pad, or if other specified conditions have been met. For example, the logic can provide a confirmation signal instructing the deactivation pad to send the deactivation pulse if the tag is close enough to the pad for successful deactivation, or in the alternative, it can provide a warning signal instructing the deactivation pad to block the deactivation pulse if the tag-to-tag distance is insufficient. Similarly, the logic can determine if an active tag is present in the read field after the deactivation pulse has been sent, and send a warning signal to the user alerting the user that at least one tag failed to properly deactivate. The logic may also generate a confirmation indication to notify a user that a tag was properly deactivated (e.g., green light 786) or that the tag is within the deactivation distance from the pad (e.g., yellow light 784). Also, the logic can generate a warning signal (e.g., red light 782) to alert the user that a tag has not been properly deactivated.

The capabilities of the logic circuitry are not limited to the examples described herein, and may include any relevant action that is capable of being controlled by a computer. Furthermore, any action managed or controlled by the logic circuitry may also be done using computer software. It is within the ability of one skilled in the art to design and implement such logic.

Portions of the detailed descriptions herein have been presented in terms of processes, procedures, logic, function(s), and/or other representations of operations within a computer, signal processor, controller, sensor and/or memory. These descriptions and representations are generally used by those skilled in the data processing arts to convey the substance of their work to others skilled in the art. A process, procedure, logic block, function, operation, etc., is herein, and is generally, considered to be a self-consistent sequence of steps or instructions leading to a desired and/or expected result. The steps generally include physical manipulations of physical quantities. Usually, though not necessarily, these quantities take the form of electrical, magnetic, optical, or quantum signals capable of being stored, transferred, combined, compared, and otherwise manipulated in a computer and/or signal/data processing system.

It should be borne in mind, however, that all of these and similar terms are associated with the appropriate physical quantities and are merely convenient labels applied to these quantities. Unless specifically stated otherwise and/or as may be apparent from the following discussions, it is appreciated that throughout the present application, discussions utilizing terms such as "processing," "determining," "displaying" or the like, refer to the action and processes of a computer or data processing system, or similar processing device (e.g., an electrical, optical, or quantum computing or processing device), that manipulates and transforms data represented as physical (e.g., electronic) quantities. The terms refer to actions, operations and/or processes of the processing devices that manipulate or transform physical quantities within the component(s) of a system or architecture (e.g., registers, memories, sensors, other such information storage, transmission or display devices, etc.) into other data similarly represented as physical quantities within other components of the same or a different system or architecture.

Although the description herein focuses on methods and hardware (e.g., architectures, systems and/or circuits), the present invention also includes a computer program and/or software, implementable and/or executable in a general purpose computer or workstation equipped with conventional digital and/or analog signal processor(s), configured to perform one or more steps of the method and/or one or more operations of the hardware. Thus, a further aspect of the invention relates to software that implements the above method(s) and/or algorithm(s). For example, the invention may further relate to a computer program, computer-readable medium containing a set of instructions which, when executed by an appropriate signal processing device, is configured to perform the methods described herein. For example, the computer-readable medium may comprise any medium that can be read by a signal processing device configured to read the medium and execute code stored thereon or therein, such as a floppy disk, CD-ROM, magnetic tape or hard disk drive. Such code may comprise object code, source code and/or binary code.

The code is generally configured for transmission through an appropriate medium, such as copper wire, a conventional network cable, a conventional optical data transmission cable, or even air or a vacuum (e.g., outer space) for wireless signal transmissions. The code is generally digital, and is generally configured for processing by a conventional digital data processor (e.g., a microprocessor, microcontroller, or logic circuit such as a programmable gate array, programmable logic circuit/device or application-specific [integrated] circuit).

As further illustrated in FIG. 7, the tag reader 750 and the deactivation pad 730 are configured to communicate with a tag 790 in the detection and/or read fields within the apparatus. The deactivation pad 730 transmits a deactivation pulse from a deactivation pulse transmitter 740 (via an antenna 745) to the tag 790 to deactivate any tag(s) within the deactivation field.

The tag reader 750 generally includes a signal transmitter 760 that transmits a RF, HF, VHF, or UHF signal and/or a signal detector 770 configured to detect a backscattered or reflected signal from the tag 790. The tag reader 750 and/or the various components of the tag reader may also include one or more antennas (e.g., 765 and 775) configured for wireless transmission and/or reception of signals between the reader and the tag. In one embodiment, a single antenna can be configured for both transmission and reception functions.

The logic 710 of the apparatus 700 is configured to generate a confirmation or warning signal to be transmitted to the confirmation indicator if a tag was properly deactivated and/or if the tag failed to deactivate. The warning and/or confirmation indication may be a tactile signal, such as a silent vibrating device. For example, the tactile signal may be generated by a pager attached to a belt that is worn by a user 788. The pager can transmit a silent vibration to confirm that the tag has been properly deactivated or warn the user that the tag has not been properly deactivated. Alternatively or additionally, the confirmation indication/warning signal may comprise visual, auditory, and/or olfactory signals perceived by the user. For example, a set of warning and/or confirmation lights 780 may alert the user that a tag has been deactivated (e.g., green light 786), that a tag has not been deactivated (e.g., red light 782), or that a tag is within the deactivation distance from the pad (e.g., yellow light 784). In the alternative, auditory signals may be used as a warning signal or confirmation indication. For example, a single bell tone may indicate that a tag is within the deactivation field, two bell tones may indicate that a deactivation pulse was sent (the tag has been deactivated) and/or that there are no active tags found during the second tag reading process, and a buzzer may indicate that the tag is not within the deactivation field or that an active tag has been located in the read field during the second read process.

CONCLUSION/SUMMARY

Thus, the present invention provides methods of deactivating a security/dual use tag and apparatuses for the same. Modifying the deactivation apparatus to include circuitry to read a security tag within a certain range of the pad, results in reliable and complete deactivation of the tag such that it does not reactivate (e.g., the "Lazarus effect"). After the read circuitry in the deactivation apparatus reads the security tag, logic in the apparatus estimates the distance between the tag and the pad, and determines when the distance is sufficiently close to deactivate the tag. If the tag is close enough to ensure high power delivery of a deactivation pulse, the pad sends the deactivation pulse. If the tag is not sufficiently close, the deactivation pulse is not sent. A sensory confirmation indication can alert a user that deactivation has occurred. In the alternative, a different sensory warning signal can alert a user if the deactivation has not occurred, so that the tag can be moved closer to the pad for deactivation. Additionally or alternatively, after the deactivation pulse from the pad is complete, a reader may read the tag (or group of tags) to ensure that there are no active tags in the read field. Confirmation indicators and/or warning signals may be subsequently sent to the user to indicate whether or not active tags remain in the deactivation field after the deactivation pulse has been sent.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A method of deactivating a security tag, comprising:

a) placing the security tag a first distance from a deactivation apparatus;

b) estimating the first distance between the tag and the deactivation apparatus by determining a coupling coefficient between the tag and the deactivation apparatus;

c) determining whether the tag is sufficiently close to the deactivation apparatus to ensure delivery of a deactivation pulse of sufficiently high power to deactivate the tag by determining whether the coupling coefficient between the tag and the deactivation apparatus exceeds a predetermined threshold value;

d) transmitting the deactivation pulse when the tag is sufficiently close;

e) determining whether a deactivation confirmation indication has occurred; and f) when the deactivation confirmation indication has been determined not to have occurred, placing the security tag a second distance closer to the deactivation apparatus than the first distance.

2. The method of claim 1, wherein the first distance is within a specified deactivation field of the deactivation apparatus.

3. The method of claim 2, further comprising reading the tag before determining whether the deactivation confirmation indication has occurred.

4. The method of claim 1, further comprising generating the deactivation confirmation indication when the first distance is sufficiently close.

5. The method of claim 1, wherein transmitting the deactivation pulse comprises transmitting the deactivation pulse from the deactivation apparatus.

6. The method of claim 5, further comprising reading the tag after transmitting the deactivation pulse.

7. The method of claim 6, further comprising generating a confirmation indication when the deactivation apparatus determines that there are no non-deactivated tags in a predetermined read field.

8. The method of claim 7, wherein the read field has a volume of at least 1.5 times that of the deactivation field.

9. The method of claim 7, further comprising generating a warning signal when the deactivation apparatus determines that there is a non-deactivated tag in the read field.

10. The method of claim 1, further comprising generating a warning signal when the first distance is not sufficiently close to the deactivation apparatus.

11. The method of claim 1, further comprising reading the tag after transmitting the deactivation pulse, determining whether there are any non-deactivated tags in a predetermined read field, and generating the deactivation confirmation indication when the tag has been deactivated.

12. The method of claim 11, wherein the deactivation confirmation indication comprises a visual or audible confirmation.

13. The method of claim 1, wherein deactivating the tag comprises forming a short circuit between two conductive plates or members across a dielectric.

14. The method of claim 13, wherein the dielectric has a breakdown voltage, and forming the short circuit comprises applying an electric potential greater than the breakdown voltage across the dielectric.

15. The method of claim 14, wherein the electric potential is generated by the tag from a radio frequency, high frequency, very high frequency, or ultra high frequency signal from the deactivation apparatus.

16. A security tag deactivation apparatus, comprising:

a) a pad configured to transmit a deactivation pulse having a power sufficient to deactivate a security tag when the security tag is within a deactivation field of the deactivation apparatus;

b) a tag reader configured to (1) determine a coupling coefficient between the tag and the pad, and (2) detect a signal transmission from a non-deactivated tag when the non-deactivated tag is within a predetermined read field of the deactivation apparatus, the read field having a greater volume than the deactivation field;

c) a confirmation indicator configured to indicate that the pad has sent the deactivation pulse; and d) logic configured to (1) estimate a distance between the tag and the pad using the coupling coefficient, (2) determine when the non-deactivated tag is within the deactivation field by determining whether the coupling coefficient between the non-deactivated tag and the pad exceeds a predetermined threshold value, and (3) communicate to the confirmation indicator that the pad has sent the deactivation pulse.

17. The apparatus of claim 16, wherein the deactivation pulse comprises a radio frequency, high frequency, very high frequency, or ultra high frequency signal.

18. The apparatus of claim 16, wherein the reader is configured to attempt to detect the signal transmission before the confirmation indicator indicates that the pad has sent the deactivation pulse.

19. The apparatus of claim 16, wherein the confirmation indicator is configured to generate a confirmation signal when the non-deactivated tag is within the deactivation field.

20. The apparatus of claim 16, wherein the logic is configured to generate a confirmation indication when the non-deactivated tag has been deactivated.

21. The apparatus of claim 20, wherein the confirmation indication comprises a visual or audible confirmation.

22. The apparatus of claim 16, wherein the reader attempts to detect the signal transmission before the pad sends the deactivation pulse.

23. The apparatus of claim 22, wherein the confirmation indicator is configured to generate a confirmation signal when the reader determines that there are no non-deactivated tags in the predetermined read field.

24. The apparatus of claim 23, wherein the reader is configured to determine whether there are non-deactivated tags in the read field by broadcasting a wireless transmission at an appropriate frequency and strength, and determining whether a reply is received.

25. The apparatus of claim 23, wherein the read field has a volume of at least 1.5 times that of the deactivation field.

26. The apparatus of claim 22, wherein the deactivation apparatus or the confirmation indicator further comprises a warning indicator mechanism configured to indicate when the deactivation apparatus determines that the non-deactivated tag is in the read field.

27. The apparatus of claim 22, wherein the deactivation pulse has a power sufficient to form a short circuit between two conductive plates or members across a dielectric in the security tag.

28. The apparatus of claim 27, wherein the dielectric has a breakdown voltage, and the deactivation pulse has a power sufficient to generate an electric potential greater than the breakdown voltage across the dielectric when the security tag is within the deactivation field.

29. A computer readable medium comprising a computer executable set of instructions adapted to perform the method of claim 1.

30. The method of claim 1, wherein the coupling coefficient is a ratio of power radiated by the deactivation apparatus to power absorbed by the tag.

31. The method of claim 30, wherein determining the coupling coefficient comprises measuring the power absorbed by the tag by measuring power drawn from an antenna of the deactivation apparatus.

32. The method of claim 30, wherein the power absorbed by the tag is between 1-20 percent of the power radiated by the deactivation apparatus.

33. The apparatus of claim 16, wherein said coupling coefficient is a ratio of power radiated by the tag reader to power absorbed by the tag.

34. The apparatus of claim 33, wherein the reader comprises read circuitry configured to measure the coupling coefficient, and wherein measuring the coupling coefficient comprises measuring the power absorbed by the tag by measuring the power drawn from an antenna of the reader.

* * * * *